US006334530B1

(12) United States Patent
Morris

(10) Patent No.: US 6,334,530 B1
(45) Date of Patent: Jan. 1, 2002

(54) JEWELRY ORGANIZER

(76) Inventor: Shannon S. Morris, P.O. Box 4124, Friday Harbor, WA (US) 98250

( * ) Notice: Subject to any disclaimer, the term of this patent is extended or adjusted under 35 U.S.C. 154(b) by 292 days.

(21) Appl. No.: 08/766,862

(22) Filed: Dec. 13, 1996

(51) Int. Cl.[7] ..... A45C 11/04
(52) U.S. Cl. ..... 206/6.1; 206/566
(58) Field of Search ..... 206/6.1, 566, 493, 206/509, 511, 564, 565, 310, 303, 348; 211/85.2; 220/506, 575; D9/341, 456; D11/76

(56) References Cited

U.S. PATENT DOCUMENTS 2,878,932 A * 3/1959 Martire, Jr. ..... 206/564
3,998,327 A * 12/1976 Box ..... 206/511
4,311,235 A * 1/1982 Titus ..... 206/566
4,341,300 A * 7/1982 Roy ..... 206/566
4,632,351 A * 12/1986 Coon ..... 206/596
4,944,398 A * 7/1990 Gatt ..... 206/564
5,040,681 A * 8/1991 Grusin ..... 206/509

* cited by examiner

*Primary Examiner*—Luan K. Bui
(74) *Attorney, Agent, or Firm*—Sheppard, Mullin, Richter & Hampton LLP

(57) ABSTRACT

An apparatus for jewelry organizational having separate compartments for keeping all types of jewelry organized and displayed, with the jewelry tangling. The jewelry organizer has a body with an upper surface and a lower surface, and at least one compartment. Each compartment defines an elongated channel in the upper surface for holding items of jewelry. The upper surface has an upwardly protruding knob sized to hold rings. The lower surface has a recess sized to mount on the knob of a second jewelry organizer for stacking thereon. The body further has an outer rim. The outer rim has a substantially flat surface for displaying items of jewelry and a lip for hooking on earrings.

17 Claims, 2 Drawing Sheets

FIG. 1
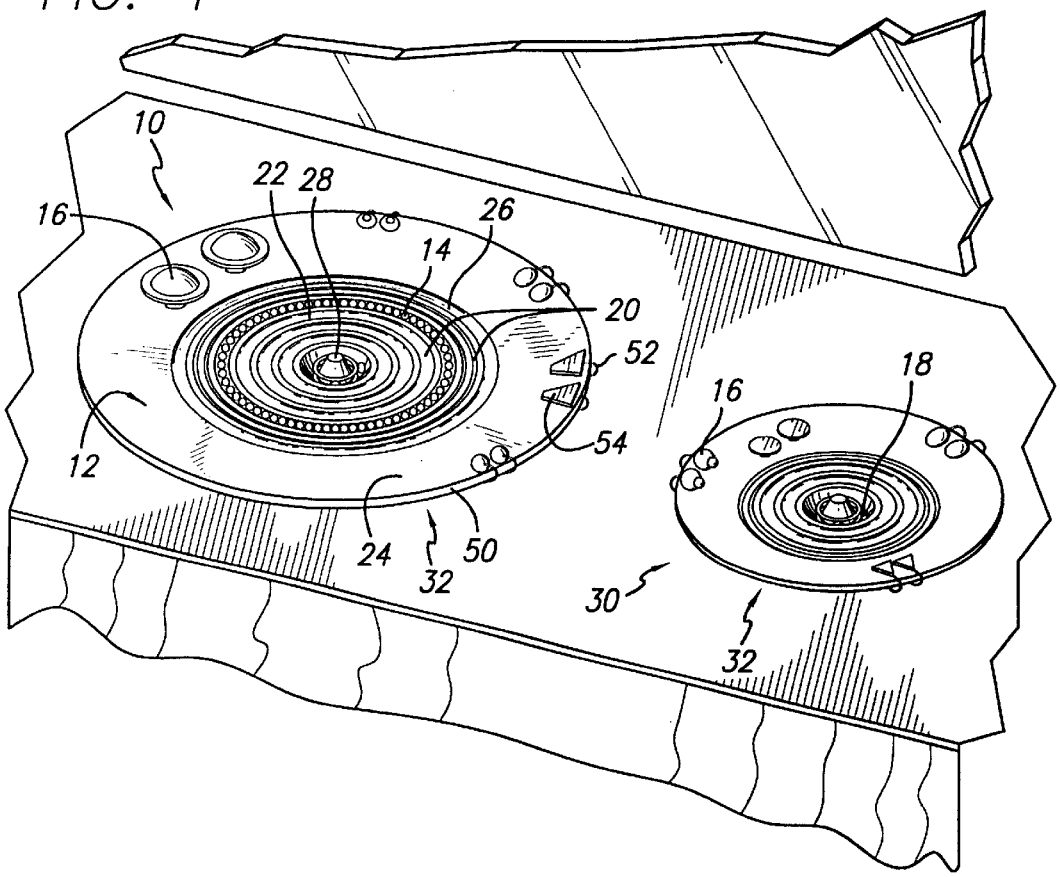
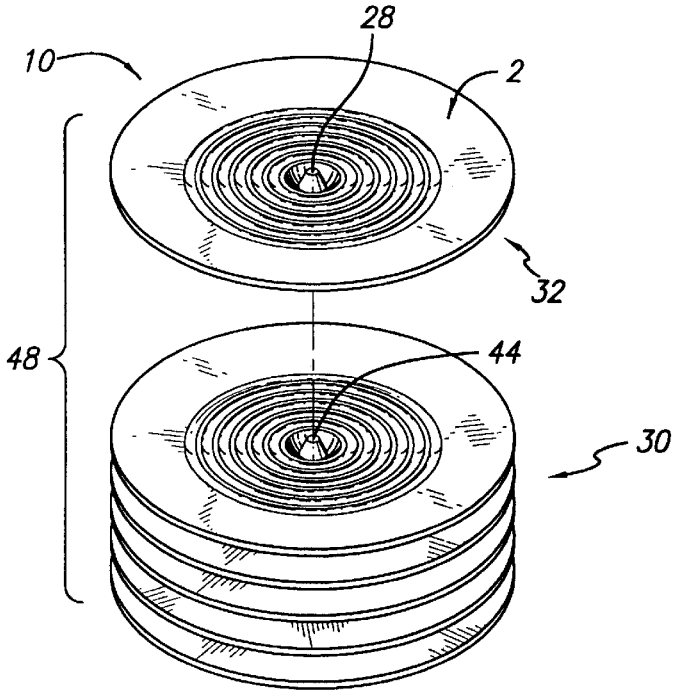
FIG. 4

JEWELRY ORGANIZER

BACKGROUND

The present invention relates to an apparatus for jewelry organization, and more particularly, to a stackable apparatus for organizing and displaying several types of jewelry without tangling.

Numerous boxes and organizers are known for storing or displaying jewelry. Such items are sold in an array of sizes and types. However, most jewelry boxes and organizers have limited space, crowding the jewelry when it is stored. This causes tangling of jewelry items, such as bracelets or necklaces. Jewelry items of length are a particular problem to store without crowding, mixing, or tangling. Hanging the jewelry does not adequately solve the tangling problem, and it requires a great deal of space to spread out the jewelry for view.

Existing jewelry boxes and organizers commonly do not allow for additional items to be stored once their original space is filled. Another drawback is that many of these boxes and organizers do not accommodate all the types of jewelry available. This requires a person to purchase several boxes or organizers and to find room on shelves, dressers, or counter tops to store each of them.

Accordingly, there exists a need for a jewelry organizer which conveniently organizes and displays several types of jewelry in limited space while keeping bracelets and necklaces from tangling with each other. There is also a need for a jewelry organizer which allows for expansion for additional pieces of jewelry. The present invention fills these needs.

SUMMARY OF THE INVENTION

Briefly, and in general terms, the present invention resides in an apparatus for jewelry organization which satisfies the above-identified needs by storing and displaying several types of jewelry while preventing the jewelry from tangling. The jewelry organizer has a body capable of stacking which is specially designed to avoid tangling of jewelry items and to house all types of jewelry at once, in an appealing fashion.

More particularly, the apparatus for jewelry organization of the present invention includes a body having an upper and lower surface, and at least one compartment formed in the upper surface. Each compartment is defined as an endless channel sized to receive one or more items of jewelry. In a presently preferred embodiment, the channels may be formed in a substantially concentric circular or rectangular pattern. The channels having the smallest circumferences can be used for holding small earrings, commonly stud or hoop earrings. The channels of medium length circumference can be used for watches, bracelets and other jewelry of similar length. A piece or strand of jewelry is placed in a channel of the length necessary to hold it. The channels having the larger diameters can be used for holding necklaces of varying lengths. Each piece of jewelry is matched to a channel of similar length so that the jewelry can be laid out along the path of the channel and does not mix or tangle with other pieces of jewelry. Alternatively, the compartment may form one continuous channel in a spiral configuration in which jewelry items, such as necklaces would be placed end-to-end.

In another aspect of the invention, the upper surface of the body has an upwardly protruding knob. The knob is approximately sized to the diameter of a finger for holding rings. The knob may be frustoconical in shape and can hold at least one ring. The presently preferred knob is located in the center of the upper surface. The lower surface of the body may have a recess which is sized to receive a knob on a second jewelry organizer. The knob nests into the recess of another jewelry organizer so that the organizers can be stacked on top of one another. This allows a person to purchase additional jewelry organizers when needed to accommodate extra jewelry, without having to find additional space in a drawer or on a dresser or counter top.

In a further aspect of the invention, the jewelry organizer may have a rim around the periphery of the outermost compartment. The rim may include a lip which has a thickness less than the hook on a typical drop earring. This allows a drop earring to be hooked onto the lip. The rim also may have a substantially flat surface and a width sufficient to display the earrings on the rim once they are hooked onto the lip. Additionally, a person may place or display clip earrings or pins on the substantially flat surface.

Because the jewelry is stored in the separated channels in the jewelry organizer, the pieces do not get lost or tangled. Yet, the jewelry organizer has the capability of holding all types of jewelry, from rings, to watches, to bracelets, to all types of earrings, and to necklaces of every length.

Other features and advantages of the present invention will become apparent from the following description of the preferred embodiment, taken in conjunction with the accompanying drawings, which illustrate, by way of example, the essence of the invention.

BRIEF DESCRIPTION OF THE DRAWINGS

The drawings illustrate a presently preferred embodiment of the invention, in which:

FIG. 1 shows a perspective view of a jewelry organizer apparatus in accordance with the present invention;

FIG. 4 is an exploded perspective view of a jewelry organizer shown in combination with several other jewelry organizers.

DESCRIPTION OF THE PREFERRED EMBODIMENT

Figure 2:
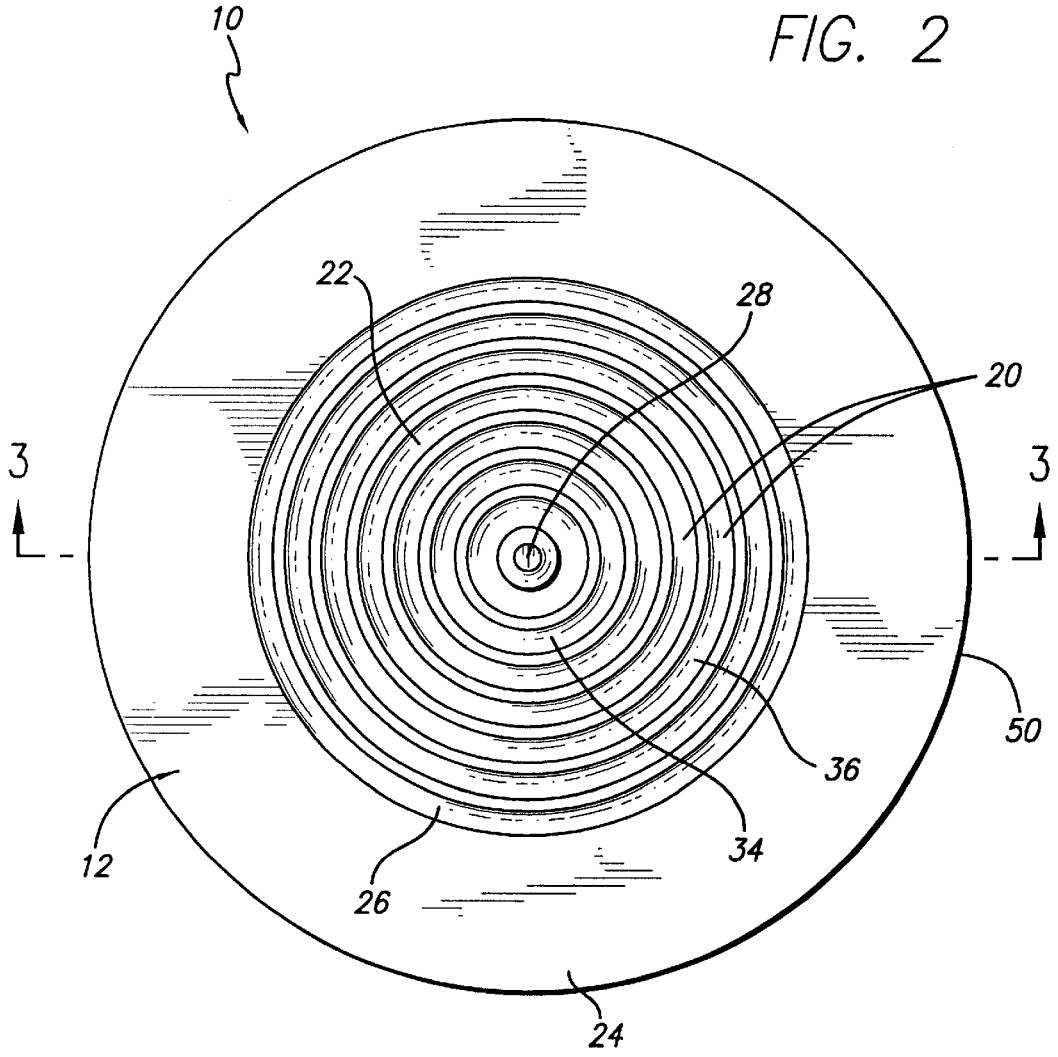
FIG. 2 is a top view of the jewelry organizer shown in FIG. 1.

Referring now to the drawings, and particularly to FIG. 1 thereof, the present invention is embodied in a jewelry organizer, generally indicated by reference numeral 10. The jewelry organizer can be made from a single piece of clay, plastic, wood, glass, cardboard or any other material capable of being fabricated into the design. The jewelry organizer has an upper surface 12 for storing and displaying all types of jewelry, such as a necklace 14, drop earrings 16, and a ring 18. The upper surface 12 defines a plurality of compartments 20 for holding the jewelry. Each compartment is an endless channel 22 which is sized to hold jewelry and keep it separate from other items of jewelry. A substantially flat rim 24 surrounds the periphery of the outermost channel or compartment 26 and allows drop earrings 16 to be hooked or clip earrings 8 to be placed thereon. The jewelry organizer 10 has an upwardly protruding knob 28 for holding rings.

As shown in FIGS. 1 and 2, the body of the jewelry organizer is a circular, plate-like structure 30, having a diameter of at least four inches. The preferable upper range of the diameter is twenty four inches. The plate-like structure includes a lower surface 32 for resting on a counter, table or dresser top. The knob 28 on the upper surface is located in the center of the plate-like structure. The knob is approximately sized to the diameter of a finger so that at least one ring can be stacked on it. The knob could also hold hoop earrings or any other jewelry of similar proportion. Preferably, the knob has a frustoconical shape and a height taller than the upper surface.

As referenced above with respect to FIGS. 1 and 2, the upper surface of the body has a plurality of compartments 20 defining endless channels 22. The channels are circular in shape and vary in diameter. The smaller diameter channels 34 lie within the channels having larger diameters 36. Thus, the channels are concentrically relative to each other and surround the knob. The number of channels can range from at least two up to eighteen or more, depending on the diameter of the jewelry organizer, the width of the channels, and the desired need.

Figure 3:
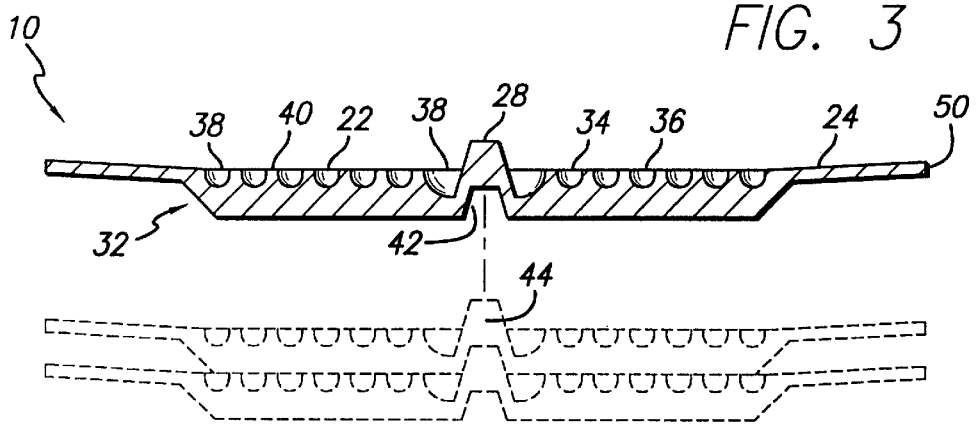
FIG. 3 is a cross-sectional view of the jewelry organizer, taken along lines 3—3 in FIG. 2, showing how it stacks on additional jewelry organizers indicated in phantom.

Referring now to FIG. 3, the knob 28 and the channels 22 are shown in more detail. The depth of each channel is sized for receiving at least one strand of jewelry in that channel. The width of each channel is approximately three-eighths of an inch, or at least adequately sized to hold a strand of jewelry. The innermost channel 38 is formed around the base of the knob and can be used to store small stud or hoop earrings. The channels in closer proximity to the knob have smaller diameters and smaller circumferences 34, and are ideally suited for holding items such as small earrings, watches, and bracelets. The outer channels, with larger diameters and larger circumferences 36, are ideally suited for holding various items of longer length, such as necklaces. Each channel is separated from the adjacent channel by the upstanding side walls of the channels 40. The top of each of the upstanding side walls 42 is approximately the same height and forms a portion of the top surface 12. The separated channels and the upstanding side walls prevent the stored items of jewelry from tangling with other items of jewelry.

As further shown in FIG. 3, the lower surface 32 has a recess 44. The recess is designed with a frustoconical shape, similar to the shape of the knob 28. The recess is aligned with and located on the underside of the knob. The recess is sized to receive a knob 46 from a second jewelry organizer 48. As shown in FIGS. 3 and 4, this enables the knob 46 on the second jewelry organizer 48 to nest into the recess 44 of the first jewelry organizer 10 and provides a means for stacking 50 two or more organizers. This configuration allows a person to create more storage space by adding extra jewelry organizers when the original jewelry organizer is full. Because the jewelry organizers stack vertically 50, the configuration does not require any additional counter top space.

As shown in FIGS. 1 and 2, the rim 24 which extends around the periphery of the outermost compartment 26 is relatively wide to display earrings 8, 16. The rim has a lip 52 at the circumferential edge of the rim. The thickness of the lip is slightly less than the width of a hook 54 on a typical drop earring 56 so that the earring can be hung on the lip by its hook. Preferably, the rim 24 is at least two inches in width so that the earring 56, when hooked on the lip, can be positioned on the rim for display.

The invention has been described above in the terms of a presently preferred embodiment so that an understanding of the invention can be conveyed. There are, however, other configurations for the jewelry organizer not specifically described herein for which the present invention is applicable. Consequently, the present invention should not be seen as limited to the particular embodiment described above. All modifications, variations, or equivalent arrangements that are within the scope of the attached claims should therefore be considered to be within the scope of the invention.

What is claimed is:

1. A jewelry organizer for holding jewelry such as rings, earrings, drop earrings, watches, bracelets, necklaces, and other strands of jewelry, comprising:

a body having an upper surface and a lower surface;

a knob protruding upwardly from the upper surface;

at least two compartments formed in the upper surface of the body for receiving jewelry, each compartment defined as an elongated channel surrounding the knob;

an outer rim around the periphery of the outermost compartment, the outer rim having a substantially flat surface; and a recess in the lower surface of the body wherein the recess and the knob provide a means for a stackable configuration.

2. The jewelry organizer of claim 1, wherein the body of the jewelry organizer is substantially planar and circular in shape.

3. The jewelry organizer of claim 2, wherein the knob has a frustoconical shape and has a diameter and height capable of holding at least one ring.

4. The jewelry organizer of claim 1, wherein each channel is formed in a substantially concentric pattern.

5. The jewelry organizer of claim 4, wherein each channel has an upstanding side wall separating each compartment from an adjacent compartment.

6. The jewelry organizer of claim 1 wherein the outer rim is at least two inches in width to allow space for an earring to be displayed.

7. The jewelry organizer of claim 6, wherein the outer rim includes a lip sized to receive a hook of a drop earring thereon.

8. A jewelry organizer for holding jewelry such as rings, earrings, drop earrings, watches, bracelets, necklaces, and other strands of jewelry, comprising:

a body having an upper surface and a lower surface;

a knob protruding upwardly from the upper surface, the knob having a diameter and height capable of receiving at least one finger ring over the knob;

at least one compartment formed in the upper surface of the body for receiving jewelry, each compartment defined as an elongated channel sized to receive a piece of jewelry;

a recess in the lower surface of the body; and an outer rim around the periphery of the outermost compartment.

9. The jewelry organizer of claim 8, wherein the knob has a diameter and height capable of receiving at least one ring.

10. The jewelry organizer of claim 9, wherein the recess is sized to receive a knob of a second jewelry organizer for stacking thereon such that sufficient space is maintained between the stacked jewelry organizers to allow jewelry to be placed in each of the compartments.

11. The jewelry organizer of claim 10, wherein the recess is placed on the knob of a second jewelry organizer, the second jewelry organizer further comprising:

a body having an upper surface and a lower surface;

a knob protruding upwardly from the upper surface;

at least one compartment formed in the upper surface of the body for receiving jewelry, each compartment defined as an elongated channel sized to receive a piece of jewelry;

a recess in the lower surface of the body; and an outer rim around the periphery of the outermost compartment.

12. The jewelry organizer of claim 8, wherein the outer rim includes a lip which is sized to receive a hook of a drop earring thereon.

13. The jewelry organizer of claim 12, wherein the outer rim has a width of at least one inch and has a substantially flat surface for displaying a drop earring when the drop earring is hooked onto the lip.

14. A jewelry organizer for holding jewelry such as rings, earrings, drop earrings, watches, bracelets, necklaces, and other strands of jewelry comprising:

a first body having an upper surface and a lower surface, a knob protruding upwardly from the upper surface, at least one compartment formed in the upper surface of the body for receiving jewelry, each compartment defined as an elongated channel, with the compartments formed in substantially concentric pattern, and an outer rim around the periphery of the outermost compartment; and a second body having an upper surface and a lower surface, at least one compartment formed in the upper surface of the body for receiving jewelry, each compartment defined as an elongated channel, with the compartments formed in substantially concentric pattern, and a recess in the lower surface of the body sized to receive the knob of the first body therein, wherein the second body is stacked on the first body by positioning the recess of the second body onto the knob of the first body.

15. The jewelry organizer of claim 14, wherein the lower surface of the first body further includes a recess, and the upper surface of the second body further includes an upwardly protruding knob capable of adding further stackable configurations.

16. The jewelry organizer of claim 14, wherein the outer rim of each body includes a lip sized to receive a hook of a drop earring.

17. The jewelry organizer of claim 16, wherein the outer rim of each body has a width of at least two inches and a substantially flat surface for displaying a drop earring when the drop earring is hooked onto the lip.

* * * * *